US005166020A

United States Patent [19]

Fukuda et al.

[11] Patent Number: 5,166,020

[45] Date of Patent: Nov. 24, 1992

[54] ELECTROPHOTOGRAPHIC PHOTORECEPTOR

[75] Inventors: Yuzuru Fukuda; Shigeru Yagi, both of Kanagawa, Japan

[73] Assignee: Fuji Xerox Co., Ltd., Tokyo, Japan

[21] Appl. No.: 584,640

[22] Filed: Sep. 19, 1990

[30] Foreign Application Priority Data

Sep. 25, 1989 [JP] Japan ..... 1-246498

[51] Int. Cl.[5] ..... G03G 5/047

[52] U.S. Cl. ..... 430/58; 430/60; 430/65; 430/131

[58] Field of Search ..... 430/58, 60, 65, 131

[56] References Cited

U.S. PATENT DOCUMENTS

| | | | |
|---|---|---|---|
| 4,369,242 | 1/1983 | Arimilli et al. | 430/58 |
| 4,634,648 | 1/1987 | Jansen et al. | 430/84 |
| 4,792,510 | 12/1988 | Kumano et al. | 430/60 X |
| 5,041,350 | 8/1991 | Yagi | 430/58 |

FOREIGN PATENT DOCUMENTS

| | | | |
|---|---|---|---|
| 158 | 1/1984 | Japan . | |
| 296052 | 12/1988 | Japan | 430/131 |
| 311262 | 12/1988 | Japan | 430/60 |
| 280768 | 11/1989 | Japan | 430/60 |
| 96178 | 4/1990 | Japan | 430/58 |

*Primary Examiner*—Roland Martin
*Attorney, Agent, or Firm*—Finnegan, Henderson, Farabow, Garrett and Dunner

[57] ABSTRACT

An electrophotographic photoreceptor is disclosed, comprising at least a substrate having thereon a charge transporting layer and a charge generating layer, wherein the charge transporting layer is a porous anodized aluminum film which is formed by anodic oxidation of a substrate at least a surface of which comprises aluminum or an aluminum alloy, with the pores thereof being filled with a metal. The electrophotographic photoreceptor can be produced by a process comprising subjecting a substrate at least a surface of which comprises aluminum or an aluminum alloy to anodic oxidation in a 1 to 30% by weight acid aqueous solution containing at least one inorganic polybasic acid selected from the group consisting of sulfuric acid, phosphoric acid, chromic acid, etc. or at least one organic polybasic acid selected from the group consisting of oxalic acid, malonic acid, tartaric acid, etc. by a direct current at a current density of from 0.1 to 10 $A \cdot dm^{-2}$ or a substantially equal electrical current to form a porous anodized aluminum film on the substrate, filling a metal in the pores of said porous anodized aluminum film by electrolysis in an aqueous solution containing a salt of the metal to form a charge transporting layer comprising the metal-filled porous anodized aluminum film, and then forming a charge generating layer on the charge transporting layer. The metal-filled porous anodized aluminum film is free from defects and exhibits satisfactory adhesion to a charge generating layer and excellent mechanical strength.

3 Claims, 1 Drawing Sheet

ELECTROPHOTOGRAPHIC PHOTORECEPTOR

FIELD OF THE INVENTION

This invention relates to an electrophotographic photoreceptor and a process for producing the photoreceptor. More particularly, it relates to an electrophotographic photoreceptor having a function separated type photosensitive layer and to a process for producing the photoreceptor.

BACKGROUND OF THE INVENTION

A so-called function separated type electrophotographic photoreceptor has a photosensitive layer composed of a charge generating layer capable of generating a charge carrier on light irradiation and a charge transporting layer into which the thus generated charge carrier can be efficiently introduced and which is capable of efficiently moving the thus generated charge carrier. In recent years, an amorphous silicon type electrophotographic photoreceptor having a charge generating layer made of amorphous silicon and a charge transporting layer made of an amorphous material which is formed by a plasma CVD method has been attracting attention because it has a possibility of basically improving charging properties and productivity of conventional amorphous silicon type electrophotographic photoreceptors without impairing excellent characteristics possessed by amorphous silicon, such as photosensitivity, high hardness, and heat stability and is therefore promising for obtaining electrical stability on repeated use and a long working life. Attention being paid on these aspects, amorphous silicon type electrophotographic photoreceptors using various charge transporting layers have been proposed. For example, a charge transporting layer which can be used in such an amorphous silicon type electrophotographic photoreceptor of separate function type includes a layer comprising silicon oxide or amorphous carbon formed by a plasma CVD method as disclosed, e.g., in U.S. Pat. No. 4,634,648.

In the above-described amorphous silicon type electrophotographic photoreceptor of separate function type, improvement in chargeability and reduction in dark decay can be brought about by using amorphous silicon as a charge generating layer and using, as a charge transporting layer, a substance having a smaller dielectric constant and higher resistance than the amorphous silicon. However, since a film formed by the above-mentioned plasma CVD method has the same rate of film formation as an amorphous type film and also has a complicated layer structure, the probability of film defects increases to reduce productivity of a photoreceptor, resulting in an extreme increase of production cost.

SUMMARY OF THE INVENTION

Accordingly, an object of this invention is to provide an electrophotographic photoreceptor having an improved charge transporting layer.

That is, one object of the present invention is to provide an electrophotographic photoreceptor having high durability in which a charge transporting layer has satisfactory adhesion to a substrate and a charge generating layer, high mechanical strength or hardness, and reduced film defects.

Another object of the present invention is to provide an electrophotographic photoreceptor which has high sensitivity, excellent panchromatic property, high chargeability, reduced dark decay, and reduced residual potential after exposure to light.

A further object of the present invention is to provide an electrophotographic photoreceptor whose charging characteristics are not affected by environmental charges.

A still further object of the present invention is to provide an electrophotographic photoreceptor which provides an image with excellent quality even on repeated use.

A yet further object of the present invention is to provide a process for producing the above-described electrophotographic photoreceptor.

The inventors previously found that an oxide of aluminum has a function as a charge transporting layer. As a result of further investigations, it has now been discovered that a charge transporting layer comprising a porous aluminum oxide film formed by a specific process, with the pores thereof being filled with a metal, shows further improvements in physical characteristics, electrophotographic characteristics, and adhesion to a charge generating layer. The present invention has been completed based on this finding.

The present invention relates to an electrophotographic photoreceptor comprising at least a substrate having thereon a charge transporting layer and a charge generating layer, wherein said charge transporting layer is a porous anodized aluminum film which is formed by anodic oxidation (anodizing) of a substrate at least a surface of which comprises aluminum or an aluminum alloy, with the pores thereof being filled with a metal.

The electrophotographic photoreceptor of the present invention can be produced by a process comprising subjecting a substrate at least a surface of which comprises aluminum or an aluminum alloy to anodic oxidation in a 1 to 30% by weight acid aqueous solution containing at least one inorganic polybasic acid selected from the group consisting of sulfuric acid, phosphoric acid, chromic acid, etc. or at least one organic polybasic acid selected from the group consisting of oxalic acid, malonic acid, tartaric acid, etc. by a direct current at a current density of from 0.1 to 10 $A \cdot dm^{-2}$ or a substantially equal electrical current to form a porous anodized aluminum film on the substrate, filling a metal in the pores of said porous anodized aluminum film by electrolysis in an aqueous solution containing a salt of the metal to form a charge transporting layer comprising the metal-filled porous anodized aluminum film, and then forming a charge generating layer on the charge transporting layer.

DETAILED DESCRIPTION OF THE INVENTION

Figure 1:
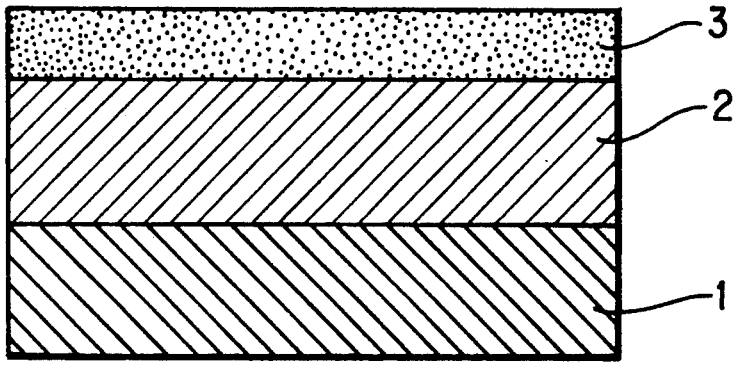
FIG. 1 illustrates a schematic cross section of an embodiment of the electrophotographic photoreceptor according to the present invention, in which numeral 1 is for a substrate, 2 for a metal-filled porous anodized aluminum film, and 3 for a charge generating layer.

FIG. 1 is a schematic cross section of the electrophotographic photoreceptor according to the present invention which comprises substrate 1, metal-filled porous anodized aluminum film 2 formed on substrate 1, and charge generating layer 3 formed on film 2.

The substrate which can be used in the present invention includes an aluminum or aluminum alloy substrate preferably having a thickness of at least 5 μm (particularly at least 20 μm) (hereinafter inclusively referred to as an aluminum substrate), other conductive substrates, and insulating substrates. In using a substrate other than an aluminum substrate, it is preferred to form an aluminum film having a thickness of at least 5 μm (particularly at least 20 μm) on the substrate at least over an area contacting with another layer. The aluminum film can be formed by vacuum evaporation, sputtering, or ion plating. Conductive substrates other than an aluminum substrate include metals, e.g., stainless steel, nickel, chromium, etc., and alloys thereof. Insulating substrates include films or sheets of high polymers, e.g., polyester, polyethylene, polycarbonate, polystyrene, polyamide, polyimide, etc., glass, and ceramics.

An aluminum material for obtaining an anodized aluminum film having satisfactory characteristics is properly chosen from among pure aluminum and aluminum alloy materials, such as Al-Mg, Al-Mg-Si, Al-Mg-Mn, Al-Mn, Al-Cu-Mg, Al-Cu-Ni, Al-Cu, Al-Si, Al-Cu-Zn, Al-Cu-Si, Al-Cu-Mg-Zn, and Al-Mg-Zn. Among these aluminum materials, Al-Mg and Al-Mn are preferred.

The porous anodized aluminum film formed on the aluminum surface of the substrate plays a roll as a charge transporting layer.

The porous anodized aluminum film is formed on the substrate by anodic oxidation as follows. A substrate with an aluminum surface having been polished to have a mirror finish and cut to a desired size is subjected to ultrasonic cleaning in an organic solvent or a flon (i.e., Freon) solvent and then in pure water.

An electrolytic solution is filled in an electrolytic cell made of stainless steel, hard glass, etc. to a prescribed level. The electrolytic solution which can be used is a 1 to 30% by weight (preferably a 5 to 25% by weight) acid aqueous solution of at least one inorganic polybasic acid selected from the group consisting of sulfuric acid, phosphoric acid, chromic acid, etc. or at least one organic polybasic acid selected from the group consisting of oxalic acid, malonic acid, tartaric acid, etc. Among these inorganic or organic polybasic acids, sulfuric acid, phosphoric acid and oxalic acid are preferred. Pure water to be used as a solvent includes distilled water and ion-exchanged water. In order to prevent corrosion of the anodized aluminum film or production of pinholes, it is particularly preferred to remove impurities, e.g., chlorine, from water.

Then, the substrate having an aluminum surface and a stainless steel plate or an aluminum plate are immersed in the electrolytic solution as an anode and a cathode, respectively, with a given electrode gap therebetween. The electrode gap is appropriately selected from 0.1 to 100 cm. A direct current power source is prepared, and its positive (plus) terminal is connected to the aluminum surface of the substrate, with the negative (minus) terminal to the cathode plate, and electricity is passed through the both electrodes in the electrolytic solution. Electrolysis is carried out by a constant current method or a constant voltage method. The direct current applied may consist solely of a direct current component or may comprise a combination of a direct current and an alternating current. A current density in carrying out anodic oxidation is set usually between 0.1 $A \cdot dm^{-2}$ and 10 $A \cdot dm^{-2}$ and preferably between 1 $A \cdot dm^{=2}$ and 6 $A \cdot dm^{-2}$. An anodizing voltage usually ranges from 1 to 150 V, and preferably from 5 to 100 V. The electrolytic solution has a temperature of from −5° to 100° C. and preferably from 10° to 80° C.

By electrolysis under these conditions, there is formed a porous anodized aluminum film on the aluminum surface of the substrate (anode).

If desired, the thus formed anodized aluminum film may be washed with pure water, followed by drying. The porous anodized aluminum film has a thickness of usually from 1 to 100 μm, and preferably from 5 to 50 μm. Further, the porous anodized aluminum film preferably has a mean pore size of from 2 to 90 nm and a porosity of from 10 to 70%.

The pores of the porous anodized aluminum film are then filled with a metal. The metal filled in the pores contributes to charge transporting property as a conductor to improve charge transporting ability of the charge transporting layer. The metal to be filled preferably includes Fe, Ni, Co, Sn, Cu, Zn, and a mixture of two or more thereof. Among these metals, Ni and Co are preferred.

Filling of the metal into pores can be performed through adsorption, deposition or precipitation of the metal by an appropriate technique, such as dipping, electrolysis, and the like. Where the metal is filled into the pores by precipitation due to electrolysis (e.g., electrodeposition), for example, the substrate having the porous anodized aluminum film is dipped in an aqueous solution containing a metal salt, and electrolysis is conducted by using an alternating current, a pulse current, or a direct current. In view of controllability on deposition, an alternating current is preferably used.

The electrolytic solution, i.e., an aqueous solution of a metal salt, includes an aqueous solution containing one or more salts of iron, nickel, cobalt, tin, copper, and zinc. Examples of suitable metal salts include ammonium ferric sulfate, nickel sulfate, cobalt sulfate, stannous sulfate, copper sulfate, and zinc sulfate. Among these, nickel sulfate and cobalt sulfate are preferred.

The aqueous solution containing the metal salt preferably contains a substance containing an organic or inorganic ion serving as a complexing agent. Substances containing an inorganic ion include boric acid, and substances containing an organic ion include citric acid, tartaric acid, phthalic acid, and malonic acid.

Electrolysis is carried out at a liquid temperature of usually from 0° to 80° C. (preferably from 5° to 60° C.) by using a commercial alternating current of usually from 2 to 100 V (preferably from 5 to 50 V).

On the thus prepared metal-filled porous anodized aluminum film, a charge generating layer is directly formed with intimate contact. A charge generating layer includes a layer of an inorganic substance, e.g., amorphous silicon, selenium, selenium hydride, and selenium-tellurium, formed by plasma CVD, vacuum evaporation, sputtering or the like technique. Additionally included in a charge generating layer is a layer formed by vacuum evaporation of a dye, e.g., phthalocyanine, copper phthalocyanine, Al-phthalocyanine, squaric acid derivatives, and bisazo dyes, or by dip coating of a dispersion of such a dye in a resin. Inter alia, a charge generating layer formed of amorphous silicon or germanium-doped amorphous silicon exhibits excellent mechanical and electrical characteristics.

A case where a charge generating layer is formed by using amorphous silicon is instanced in illustration.

A charge generating layer mainly comprising amorphous silicon can be formed by a process appropriately selected according to the purpose from among known techniques, such as glow discharge decomposition, sputtering, ion plating, and vacuum evaporation. Glow discharge decomposition of silane or a silane type gas by plasma CVD is preferred. According to the process, a film containing an adequate amount of hydrogen which has relatively high dark resistance and high photosensitivity and thus exhibits favorable characteristics as a charge generating layer can be formed.

A plasma CVD method will be illustrated below.

Raw materials for forming an amorphous silicon photosensitive layer mainly comprising silicon include silanes, e.g., monosilane and disilane. If desired, a carrier gas, e.g., hydrogen, helium, argon, and neon, may be used in the formation of a charge generating layer. These starting gases may be doped with diborane ($B_2H_6$), phosphine ($PH_3$), etc. to form a layer containing an impurity element, e.g., boron, phosphorus, etc. For the purpose of increasing photosensitivity, etc., the photosensitive layer may further contain a halogen atom, a carbon atom, an oxygen atom, a nitrogen atom, etc. For the purpose of increasing sensitivity to a longer wavelength region, the layer may furthermore contain germanium, tin, etc.

The charge generating layer which can be preferably used in the present invention mainly comprises silicon and contains from 1 to 40 atom %, and particularly from 5 to 20 atom %, of hydrogen. The thickness of the charge generating layer is in the range of usually from 0.1 to 30 μm, and preferably of from 0.2 to 5 μm.

Conditions of forming a charge generating layer are usually from 0 to 5 GHz, preferably from 3 to 5 GHz, in frequency; usually from $1\times10^{-5}$ to 5 Torr (0.001 to 665 Pa), preferably from $1\times10^{-1}$ to 3 Torr in degree of vacuum on discharging; and usually from 100° to 400° C., preferbly from 150° to 300° C. in substrate heating temperature.

If desired, the electrophotographic photoreceptor of the present invention may have a surface protective layer for preventing alteration due to corona ion.

The present invention is now illustrated in greater detail with reference to Examples, but it should be understood that the present invention is not deemed to be limited thereto.

EXAMPLE 1

An aluminum pipe (diameter: about 120 mm) made of an aluminum alloy containing 4 wt % Mg was cleaned with flon and then with ultrasonic waves in distilled water to form a substrate. Subsequently, the aluminum pipe was subjected to anodic oxidation in pure water containing 12 wt % of sulfuric acid kept at 20° C. by applying a direct voltage of 15 V between the aluminum pipe and a cathode of a stainless steel plate at a current density of 2.3 $A\cdot dm^{-2}$ for 60 minutes to form a 25 μm thick porous anodized aluminum film.

The aluminum pipe was thoroughly washed with distilled water and immersed in an aqueous solution containing 45 g/l of cobalt sulfate and 20 g/l of boric acid. Alternating electrolysis was conducted at a liquid temperature of 25° C. and an effective voltage of 15 V to precipitate cobalt in the pores of the porous layer.

The aluminum pipe having the Co-filled porous anodized aluminum film was subjected to ultrasonic cleaning in distilled water, dried at 50° C., and placed in a vacuum chamber of a capacitively coupled-type type plasma CVD apparatus. The aluminum pipe being maintained at 200° C., 100 wt % silane gas ($SiH_4$), hydrogen-diluted 100 ppm diborane gas ($B_2H_6$), and 100% hydrogen gas ($H_2$) were introduced therein at a rate of 250 ml/min, 3 ml/min, and 250 ml/min, respectively. After the inner pressure of the vacuum chamber was set at 1.5 Torr (200.0 $N/m^2$), a high-frequency electric power of 13.56 MHz was applied to cause glow discharge, and the output of the high-frequency power source was maintained at 350 W. There was thus formed a 2 μm thick charge generating layer comprising so-called i-type amorphous silicon to obtain an electrophotographic photoreceptor.

Positive chargeability of the resulting photoreceptor was measured. When an electric current of 10 μA/cm was passed through the photoreceptor, the initial surface potential immediately after charging was 670 V, and the dark decay rate was 13%/SEL. The residual potential after exposure to white light was 50 V, and the half-decay exposure amount (i.e., exposure required for the half decay of the surface potential) was 8 $erg.cm^{-2}$. A ratio of residual potential to initial surface potential, an indication of charge transporting properties, was found to be 0.07 (the charge transporting properties for the practical use is 0.2 or less). Adhesion between the charge generating layer and the porous anodized aluminum film was proved satisfactory.

COMPARATIVE EXAMPLE 1

An electrophotographic photoreceptor was prepared in the same manner as in Example 1, except that a charge generating layer was directly formed on the porous anodized aluminum film without filling the pores with cobalt.

The resulting photoreceptor was evaluated in the same manner as in Example 1. The results obtained are shown below.

Initial Surface Potential: 700 V
Dark Decay: 10%/SEL
Residual Potential: 170 V
Half Decay Exposure Amount: 9 $erg.cm^{-2}$
Charge Transporting Properties: 0.24.

EXAMPLE 2

The same aluminum pipe as used in Example 1 was subjected to anodic oxidation in the same manner as in Example 1, except that anodic oxidation was carried out in a 15 wt % sulfuric acid aqueous solution kept at 25° C. by applying a direct voltage of 16 V at a current density of 2.4 $A\cdot dm^{-2}$ for 55 minutes, to form a 23 μm thick porous anodized aluminum film.

After being thoroughly washed with distilled water, the aluminum pipe was immersed in an aqueous solution containing 25 g/l of nickel sulfate and 30 g/l of boric acid, and alternating electrolysis was conducted at a liquid temperature of 25° C. and an effective voltage of 15 V to precipitate nickel in the pores of the porous layer.

A charge generating layer was then formed thereon in the same manner as in Example 1. The resulting electrophotographic photoreceptor was evaluated in the same manner as in Example 1. The results obtained are shown below.

Initial Surface Potential: 630 V
Dark Decay: 14%/SEL
Residual Potential: 52 V
Half Decay Exposure Amount: 8 $erg.cm^{-2}$
Charge Transporting Properties: 0.08

COMPARATIVE EXAMPLE 2

An electrophotographic photoreceptor was prepared in the same manner as in Example 2, except that a charge generating layer was directly formed on the porous anodized aluminum film without filling the pores with nickel.

The resulting photoreceptor was evaluated in the same manner as in Example 1. The results obtained are shown below.

Initial Surface Potential: 690 V
Dark Decay: 10%/SEL
Residual Potential: 180 V
Half Decay Exposure Amount: 10 erg.cm$^{-2}$
Charge Transporting Properties: 0.26

EXAMPLE 3

The same aluminum pipe as used in Example 1 was subjected to anodic oxidation in the same manner as in Example 1, except that anodic oxidation was carried out in a 5 wt % phosphoric acid aqueous solution kept at 30° C. by applying a direct voltage of 50 V at a current density of 2.2 A·dm$^{-2}$ for 60 minutes, to form a 24 μm thick porous anodized aluminum film.

After being thoroughly washed with distilled water, the aluminum pipe was immersed in an aqueous solution containing 10 g/l of stannous sulfate and 5 g/l of ammonium sulfate, and alternating electrolysis was conducted at a liquid temperature of 25° C. and an effective voltage of 35 V to precipitate tin in the pores of the porous layer.

A charge generating layer was then formed thereon in the same manner as in Example 1. The resulting electrophotographic photoreceptor was evaluated in the same manner as in Example 1. The results obtained are shown below.

Initial Surface Potential: 550 V
Dark Decay: 14%/SEL
Residual Potential: 35 V
Half Decay Exposure Amount: 8 erg.cm$^{-2}$
Charge Transporting Properties: 0.06

COMPARATIVE EXAMPLE 3

An electrophotographic photoreceptor was prepared in the same manner as in Example 3, except that a charge generating layer was directly formed on the porous anodized aluminum film without filling the pores with tin.

The resulting photoreceptor was evaluated in the same manner as in Example 1. The results obtained are shown below.

Initial Surface Potential: 600 V
Dark Decay: 9%/SEL
Residual Potential: 130 V
Half Decay Exposure Amount: 8 erg.cm$^{-2}$
Charge Transporting Properties: 0.22

EXAMPLE 4

The same aluminum pipe as used in Example 1 was subjected to anodic oxidation in the same manner as in Example 1, except that anodic oxidation was carried out in a 3 wt % oxalic acid aqueous solution kept at 20° C. by applying a direct voltage of 30 V at a current density of 1.7 A·dm$^{-2}$ for 90 minutes, to form a 28 μm thick porous anodized aluminum film.

After being thoroughly washed with distilled water, the aluminum pipe was immersed in an aqueous solution containing 25 g/l of nickel sulfate and 30 g/l of boric acid, and alternating electrolysis was conducted at a liquid temperature of 20° C. and an effective voltage of 15 V to precipitate nickel in the pores of the porous layer.

A charge generating layer was then formed thereon in the same manner as in Example 1. The resulting electrophotographic photoreceptor was evaluated in the same manner as in Example 1. The results obtained are shown below.

Initial Surface Potential: 770 V
Dark Decay: 12%/SEL
Residual Potential: 110 V
Half Decay Exposure Amount: 11 erg.cm$^{-2}$
Charge Transporting Properties: 0.14

COMPARATIVE EXAMPLE 4

An electrophotographic photoreceptor was prepared in the same manner as in Example 4, except that a charge generating layer was directly formed on the porous anodized aluminum film without filling the pores with nickel.

The resulting photoreceptor was evaluated in the same manner as in Example 1. The results obtained are shown below.

Initial Surface Potential: 800 V
Dark Decay: 10%/SEL
Residual Potential: 260 V
Half Decay Exposure Amount: 10 erg.cm$^{-2}$
Charge Transporting Properties: 0.32

EXAMPLE 5

The same aluminum pipe as used in Example 1 was subjected to anodic oxidation in the same manner as in Example 1, except that anodic oxidation was carried out in a 18 wt % sulfuric acid aqueous solution kept at 25° C. by applying a direct voltage of 15 V at a current density of 1.8 A·dm$^{-2}$ for 70 minutes, to form a 24 μm thick porous anodized aluminum film.

After being thoroughly washed with distilled water, the aluminum pipe was immersed in an aqueous solution containing 30 g/l of copper sulfate and 10 g/l of sulfuric acid, and alternating electrolysis was conducted at a liquid temperature of 25° C. and an effective voltage of 15 V to precipitate copper in the pores of the porous layer.

A charge generating layer was then formed thereon in the same manner as in Example 1. The resulting electrophotographic photoreceptor was evaluated in the same manner as in Example 1. The results obtained are shown below.

Initial Surface Potential: 590 V
Dark Decay: 14%/SEL
Residual Potential: 55 V
Half Decay Exposure Amount: 9 erg.cm$^{-2}$
Charge Transporting Properties: 0.09

COMPARATIVE EXAMPLE 5

An electrophotographic photoreceptor was prepared in the same manner as in Example 5, except that a charge generating layer was directly formed on the porous anodized aluminum film without filling the pores with copper.

The resulting photoreceptor was evaluated in the same manner as in Example 1. The results obtained are shown below.

Initial Surface Potential: 640 V
Dark Decay: 10%SEL
Residual Potential: 160 V
Half Decay Exposure Amount: 9 erg.cm$^{-2}$ Charge Transporting Properties: 0.25

As described above, the electrophotographic photoreceptor according to the present invention having a metal-filled porous anodized aluminum film as a charge transporting layer, on which a charge generating layer is provided, exhibits high sensitivity, excellent panchromatic property, high chargeability, reduced dark decay, and reduced residual potential after exposure to light. The photoreceptor of the present invention, the charging characteristics thereof being not affected by environmental changes, provides an image of excellent quality even on repeated use. The photoreceptor also has very excellent adhesion between the charge transporting layer and charge generating layer, and high mechanical strength or hardness with reduced defects. Hence, the electrophotographic photoreceptor of the present invention has excellent durability.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a substrate having thereon a charge transporting layer and a charge generating layer, wherein said charge transporting layer is a porous anodized aluminum film having a thickness of 5 μm to 50 μm, a mean pore size of 2 nm to 90 nm, and from 10% to 70% porosity, said porous anodized aluminum film being formed by anodic oxidation of said substrate and having at least one surface comprising aluminum or an aluminum alloy, with the pores of said porous anodized aluminum film being filled with at least one metal selected from the group consisting of Fe, Ni, Co, Sn, Cu and Zn.

2. The electrophotographic photoreceptor of claim 1, wherein said charge generating layer comprises amorphous silicon.

3. The electrophotographic photoreceptor of claim 1, wherein said metal is Ni, Co, or a mixture thereof.

* * * * *